US009074349B2

(12) United States Patent
Goodwin

(10) Patent No.: US 9,074,349 B2
(45) Date of Patent: Jul. 7, 2015

(54) EXCAVATION TOOTH ASSEMBLY

(75) Inventor: Steven Goodwin, Regents Park (AU)

(73) Assignee: Bradken Resources PTY Limited, Mayfield West (AU)

( * ) Notice: Subject to any disclaimer, the term of this patent is extended or adjusted under 35 U.S.C. 154(b) by 223 days.

(21) Appl. No.: 13/574,226

(22) PCT Filed: Jan. 20, 2011

(86) PCT No.: PCT/AU2011/000054

§ 371 (c)(1),
(2), (4) Date: Aug. 29, 2012

(87) PCT Pub. No.: WO2011/088507

PCT Pub. Date: Jul. 28, 2011

(65) Prior Publication Data

US 2013/0000161 A1 Jan. 3, 2013

(30) Foreign Application Priority Data

Jan. 20, 2010 (AU) ..... 2010900213
Oct. 25, 2010 (AU) ..... 2010904749
Nov. 17, 2010 (AU) ..... 2010905098

(51) Int. Cl.
*E02F 9/28* (2006.01)

(52) U.S. Cl.
CPC ..... *E02F 9/2825* (2013.01); *E02F 9/2841* (2013.01)

(58) Field of Classification Search
CPC ..... E02F 9/2841; E02F 9/2883; E02F 9/2825; E02F 9/2833; E02F 9/2875; Y10T 403/7066; Y10T 403/585; Y10T 403/589; Y10T 403/7056; Y10T 403/7069; Y10T 29/4973
USPC ..... 37/446, 450–460; 172/713, 719, 172/701.1–701.3, 772, 772.5, 750–753; 403/291, 373, 374.1, 355, 378–379.6
See application file for complete search history.

(56) References Cited

U.S. PATENT DOCUMENTS 4,192,089 A 3/1980 Schwappach
4,404,760 A 9/1983 Hahn et al.
4,414,764 A * 11/1983 Johansson et al. ..... 37/450
4,663,867 A 5/1987 Hahn et al.
4,823,487 A 4/1989 Robinson (Continued)

FOREIGN PATENT DOCUMENTS

AU 2009101186 12/2009
WO WO-94/18401 8/1994
WO WO-03/004782 1/2003

OTHER PUBLICATIONS

Goodwin et al., U.S. Office Action mailed Apr. 4, 2014, directed to U.S. Appl. No. 13/574,235; 7 pages.

(Continued)

*Primary Examiner* — Robert Pezzuto
(74) *Attorney, Agent, or Firm* — Morrison & Foerster LLP

(57) ABSTRACT

An excavation tooth assembly comprising: a first tooth member comprising a body having a first end and an opposite second end that incorporates a socket configured to receive the nose portion of a second tooth member, the first tooth member also comprising laterally facing opposing surfaces, the opposing surfaces and one or more surfaces of the second tooth member defining at least in part a locking space; and a lock which is configured to be inserted into the locking space in an operative position to lock the first tooth member to the second tooth member.

24 Claims, 19 Drawing Sheets

(56) References Cited

U.S. PATENT DOCUMENTS

| | | | | | |
|---|---|---|---|---|---|
| 4,965,945 | A | * | 10/1990 | Emrich | 37/456 |
| 5,152,088 | A | | 10/1992 | Hahn | |
| 5,233,770 | A | * | 8/1993 | Robinson | 37/456 |
| 5,272,824 | A | * | 12/1993 | Cornelius | 37/458 |
| 5,423,138 | A | * | 6/1995 | Livesay et al. | 37/456 |
| 5,469,648 | A | * | 11/1995 | Jones et al. | 37/457 |
| 5,561,925 | A | * | 10/1996 | Livesay | 37/455 |
| 6,018,896 | A | | 2/2000 | Adamic | |
| 6,030,143 | A | | 2/2000 | Kreitzberg | |
| 6,385,871 | B1 | | 5/2002 | Quarfordt | |
| 6,865,828 | B1 | | 3/2005 | Molino et al. | |
| 7,086,185 | B2 | * | 8/2006 | Pasqualini et al. | 37/468 |
| RE40,336 | E | | 5/2008 | Fernandez Muñoz et al. | |
| 7,367,144 | B2 | | 5/2008 | Jones et al. | |
| 2007/0084094 | A1 | | 4/2007 | Bentley | |
| 2008/0092413 | A1 | | 4/2008 | McClanahan et al. | |

OTHER PUBLICATIONS

International Search Report and Written Opinion mailed Apr. 27, 2011, directed to International Application No. PCT/AU2011/000053; 11 pages.

International Search Report and Written Opinion mailed Apr. 27, 2011, directed to International Application No. PCT/AU2011/000054; 11 pages.

International Search Report and Written Opinion mailed Apr. 27, 2011, directed to International Application No. PCT/AU2011/000059; 17 pages.

Goodwin et al., U.S. Office Action mailed Nov. 13, 2014, directed to U.S. Appl. No. 13/574,235; 9 pages.

Goodwin et al., U.S. Office Action mailed Nov. 17, 2014, directed to U.S. Appl. No. 13/574,217; 5 pages.

Goodwin et al., U.S. Office Action mailed Apr. 7, 2015, directed to U.S. Appl. No. 13/574,217; 8 pages.

* cited by examiner

EXCAVATION TOOTH ASSEMBLY

CROSS-REFERENCE TO RELATED APPLICATIONS

This application is a national stage application under 35 USC 371 of International Application No. PCT/AU2011/000054, filed Jan. 20, 2011, which claims the priority of Australian Patent Application nos. 2010900213, filed Jan. 20, 2010, 2010904749, filed Oct. 25, 2010, and 2010905098, filed Nov. 17, 2010, the contents of which prior applications are incorporated herein by reference.

FIELD OF THE INVENTION

The disclosure relates to excavation tooth assemblies, lock assemblies for use in such tooth assemblies and to components of such excavation tooth and lock assemblies. The disclosure has application in land based digging equipment and is herein described in that context. However, it is to be appreciated that the disclosure has broader application for example in waterborne excavation equipment such as dredgers, and is therefore not limited to that application.

BACKGROUND OF THE INVENTION

Excavation teeth are provided on the digging edge of various pieces of digging equipment such as the buckets of front end loaders. Each excavation tooth is formed of a number of parts, commonly a point, an adapter and a lock. The adapter is typically fitted to the excavation equipment and the point fits over the adapter and is retained in place by the lock. In some instances one or more intermediate parts may be also included between the point and the adapter. For ease of description it is to be understood that, unless the context requires otherwise, the term "adapter" used in this specification includes both the adapter arranged to be fitted to the excavation equipment or, if one or more intermediate parts are provided, to that intermediate part(s) or to the combination of the adapter and the intermediate part(s).

The reason that the excavation tooth is formed of a number of parts is to avoid having to discard the entire tooth when only parts of the tooth, in particular the ground engaging part of the tooth (i.e. the point) is worn or broken.

Various types of locks, points and adapters are known. However, it is always desirable to design new excavation tooth assemblies and parts thereof.

SUMMARY OF THE INVENTION

According to one aspect of the disclosure, there is provided an excavation tooth assembly comprising:

- a first tooth member comprising a body having a first end and an opposite second end that incorporates a socket configured to receive the nose portion of a second tooth member, the first tooth member also comprising laterally facing opposing surfaces at the second end, the opposing surfaces and one or more surfaces of the second tooth member defining at least in part a locking space; and
- a lock which is configured to be inserted into the locking space in an operative position to lock the first tooth member to the second tooth member.

In one form, the first tooth member may be a point comprising a body incorporating a first digging end and an opposite second end that incorporates the socket. In this embodiment the second tooth member is an adapter.

In another embodiment, the first and second tooth members each form part of an adapter arranged to receive a point.

The opposing surfaces may be provided by projections projecting from the point body at its second end.

The opposing surfaces may comprise upper and lower opposing surface portions, the top and bottom of the lock held between the upper and lower opposing surface portions respectively.

The upper opposing surface portion may be spaced from the lower opposing surface portion.

The upper and lower opposing surface portions may be located above and below the socket respectively, The first tooth member may comprise an ear extending from the second end of the first tooth member's body, the ear providing one of the laterally facing opposing surfaces of the locking space.

Respective ones of the upper and lower opposing surface portions may be disposed on upper and lower projections respectively. In one form, these laterally facing surfaces may face outwardly and be in opposing relation with the ear. In this arrangement, the opposing surface portions have one surface formed on a projection and the other surface formed on the ear.

The first tooth member may comprise at least one transverse ridge, the ridge having opposite end portions wherein one of those end portions provides one of the opposing surfaces which defines the locking space. This end portion provides a surface which opposes a surface of the ear.

The first tooth member may comprise two, preferably upper and lower, ridges.

The upper and lower ridges may form, respectively, one of the surfaces of the upper and lower opposing surface portions.

Each ridge may project from a rear surface at the second end of the first tooth member's body. Preferably, the socket opens in the rear surface.

The upper and lower ridges may project from the rear surface above and below the opening of the socket.

Each ridge may be concave such that its end portions project further from the rear surface of the first tooth member's body than a central portion of that ridge.

The first tooth member may comprise two ears extending from the second end of the first tooth member's body. In this embodiment, each ear may be located on respective sides of the first tooth member.

Each ridge may extend between the two ears, with their opposite end portions spaced from respective ears.

In another embodiment, the opposing surfaces may be provided by an indentation in the first tooth member's body at its second end.

The opposing surfaces may extend from a rear portion of the first tooth member towards the front of the first tooth member.

The excavation tooth assembly may comprise an engaging element formed on one of the surfaces defining the locking space and an engaging element formed on the lock, the engaging elements arranged to interengage to releaseably retain the lock within the locking space.

Each engaging element may be a recess or a detent.

The excavation tooth assembly may further comprise the second tooth member having the nose portion receivable in the socket of the first tooth member.

According to a further aspect of the disclosure, there is provided an excavation tooth member comprising:

- a body having a first end and an opposite second end that incorporates a socket configured to receive the nose portion of a further tooth member; and laterally facing opposing surfaces at the second end of the body, the opposing surfaces defining at least in part a locking space when the tooth member is assembled with the further tooth member, the locking space arranged to receive a lock for locking the tooth member to the further tooth member.

According to a still further aspect of the disclosure, there is provided an excavation tooth assembly comprising:

a first tooth member having a socket opening in a rear surface for receiving a nose portion of a second tooth member, the first tooth member also having at least one ear extending from the rear surface and at least one projection projecting from the rear surface and spaced from the ear such that the projection and the ear have opposing surfaces, the opposing surfaces of the projection and the ear and the rear surface defining at least in part a locking space; and a lock which is configured to be inserted into the locking space in an operative position to lock the first tooth member to the second tooth member.

According to another aspect of the disclosure, there is provided an excavation tooth member comprising:

a body having a first end and an opposite second end that incorporates a socket opening in a rear surface of the body and configured to receive a nose portion of a further tooth member;

at least one ear extending from the rear surface; and at least one projection projecting from the rear surface and spaced from the ear such that the projection and the ear have opposing surfaces, the opposing surfaces of the projection and the ear and the rear surface at least partly defining a locking space that is arranged to receive a lock to lock the tooth member to the further tooth member.

According to a further aspect of the present invention there is provided an excavation tooth member having any one or more of the features described above in respect of the first tooth member.

BRIEF DESCRIPTION OF THE DRAWINGS

Embodiments will now be described, by way of example only, with reference to the accompanying drawings, in which.

DETAILED DESCRIPTION OF THE INVENTION

Figure 1:
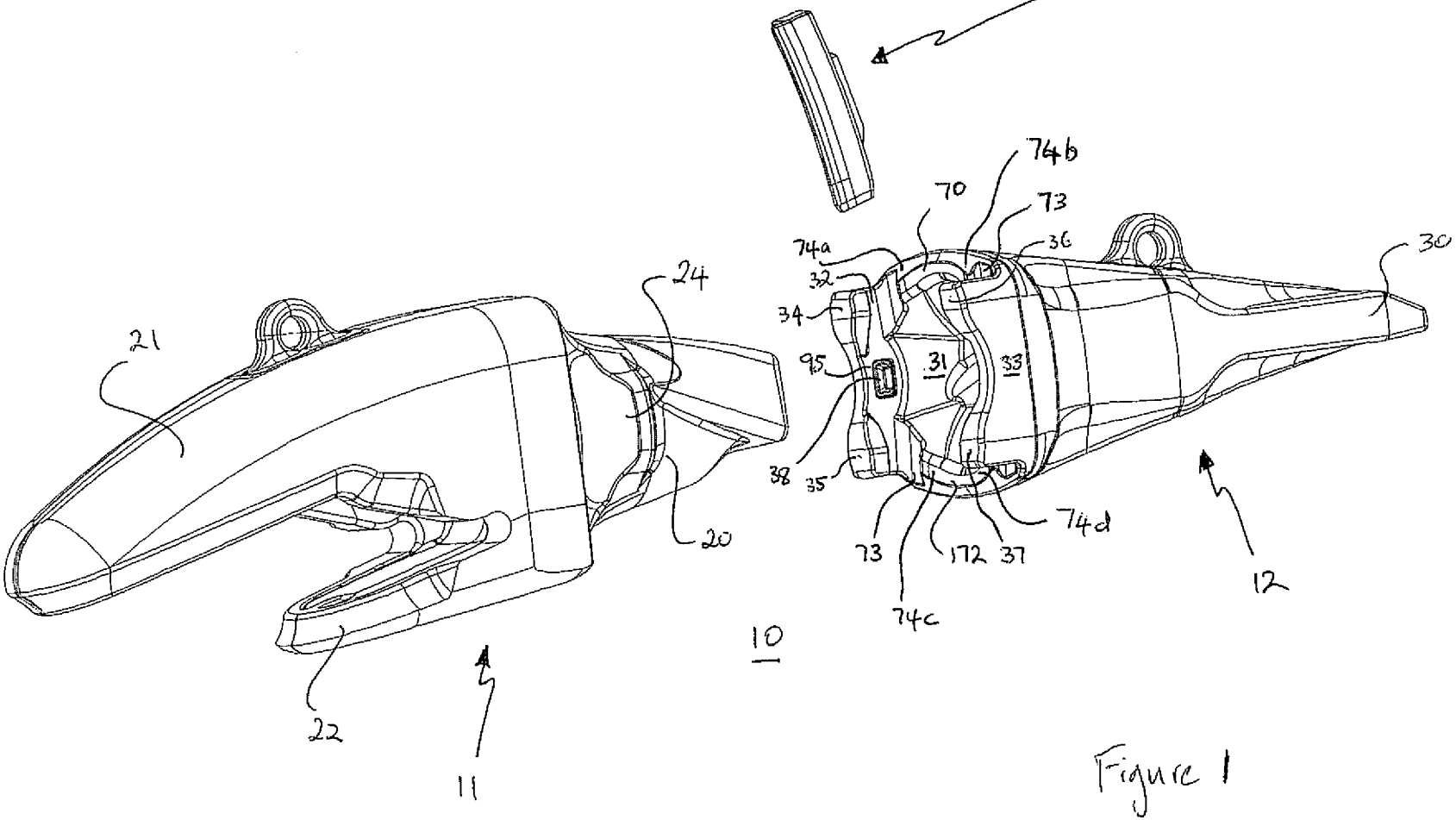
FIG. 1 is an exploded perspective view of an excavation tooth assembly according to an embodiment, comprising an excavation tooth point, an excavation tooth adapter and a lock.
Figure 2:
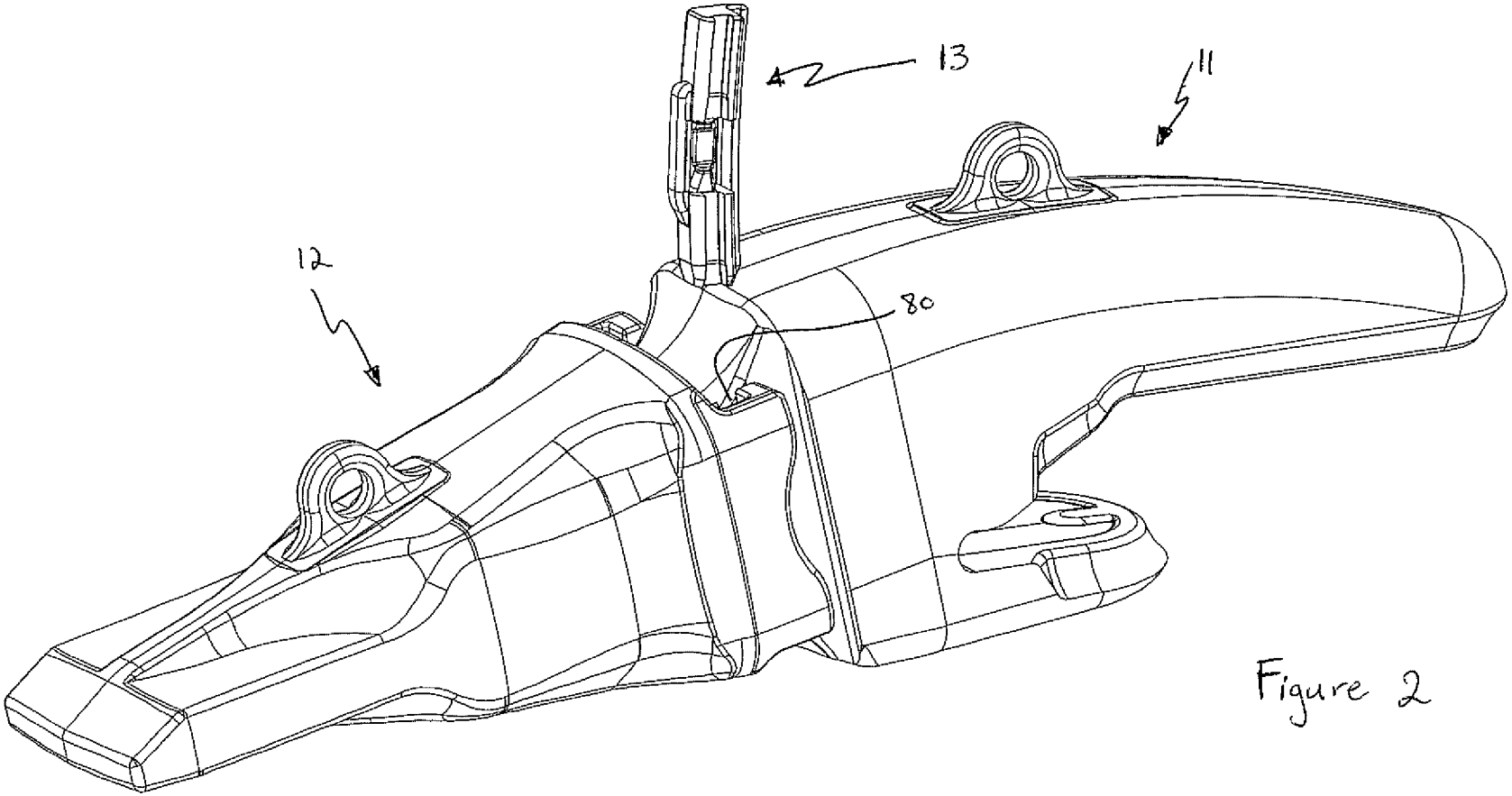
FIG. 2 is a perspective view of the excavation tooth assembly of FIG. 1 showing the lock being inserted in a locking space between the point and the adapter to lock the point to the adapter.

Referring to FIGS. 1-9, there is shown an excavation tooth assembly 10 according to an embodiment which can be assembled to form an excavation tooth. The assembly 10 comprises an excavation tooth adapter 11 for mounting the excavation tooth to the digging edge of digging equipment, an excavation tooth point 12 for coupling to the adapter 11 and a lock 13 for locking the point 12 to the adapter 11 to form the excavation tooth.

It is to be understood, that the embodiments described below could be applied to excavation tooth assemblies having different types of adapters as well as to assemblies having intermediate parts disposed between the point and the "adapter". It is also to be understood that the embodiments described below could be applied to excavation teeth for land based equipment such as digging buckets as well as to water related equipment such as dredges.

The adapter 11 comprises a forward projecting nose 20 and rearward arms 21, 22. The rearward arms 21, 22 are positioned either side of the digging edge of digging equipment in order to mount the adapter 11 thereto. In the illustrated form, the forward projecting nose 20 has a 'twisted' shape to reduce the torsion stresses on the adapter in use. However, it is to be appreciated that the nose may have other shapes as will be appreciated by those skilled in the art. Ledges 24 are also provided on either side of the adapter between the nose 20 and the rearward arms. The purpose of these ledges will become apparent further on in the specification.

The point 12 comprises a digging edge 30 at a first end which engages the ground in use and a socket 31 at an opposite second end for receiving the nose 20 of the adapter 11. The socket 31 has an internal 'twisted' shape, which conforms with the shape of the adapter nose 20. The point 12 is thus coupled to the adapter 11 by positioning the socket 31 at the end of the nose 20 and then twisting and pushing the point 12 until the nose 20 is received in the socket. Ears 32, 33 on either side of the point 12 extend rearwardly of the socket 31. Each ear 32, 33 has upper and lower lugs 34-37 extending inwardly at the distal end of their respective ears 32, 33. When the point 12 is coupled to the adapter 11 with the adapter nose 11 fully received in the point socket 31, the lugs 34-37 are located behind the adapter ledges 24 relative to the socket 31. In this arrangement, the ears 32, 33, the lugs 34-37 and the ledges 24 create locking spaces 80 on either side of the excavation tooth into which the lock 13 can be inserted to lock the point to the adapter in an operative position.

The point 12 also comprises a detent 38 for being received in a recess of the lock 13 to lock the point to the adapter. The detent 38 and the recess form a lock assembly and when coupled act to releaseably retain the lock within the locking space. The detent 38 has a general trapezoidal prism shape and is a projection which is elongate transverse to the longitudinal direction of the point 12 (although it may be elongate in the longitudinal direction in other embodiments). However, the detent may be of any other suitable shape such as cylindrical or rectangular prism for example. The detent 38 is located on and protrudes inwardly from a depression 95 in the inner surface of one of the ears 32 at an intermediate portion of the ear 32 located vertically between the lugs 34, 35. A further detent (not shown) is provided on the other ear 33. This further detent is identical to the detent 38 shown and is located at an identical position on the other ear 33 to the location of the detent 38 on the ear 32. This enables the point 12 to be coupled and locked to the adapter 11 in an upside down orientation to that shown in FIGS. 1-9. This is particularly useful in extending the life of the point 12 if the digging edge 30, in use, is wearing more on the top or bottom. A lug 34, 37 on each wall may be provided with an lug recess for co-operating with a different type of lock to the lock 13 described below.

Figure 3:
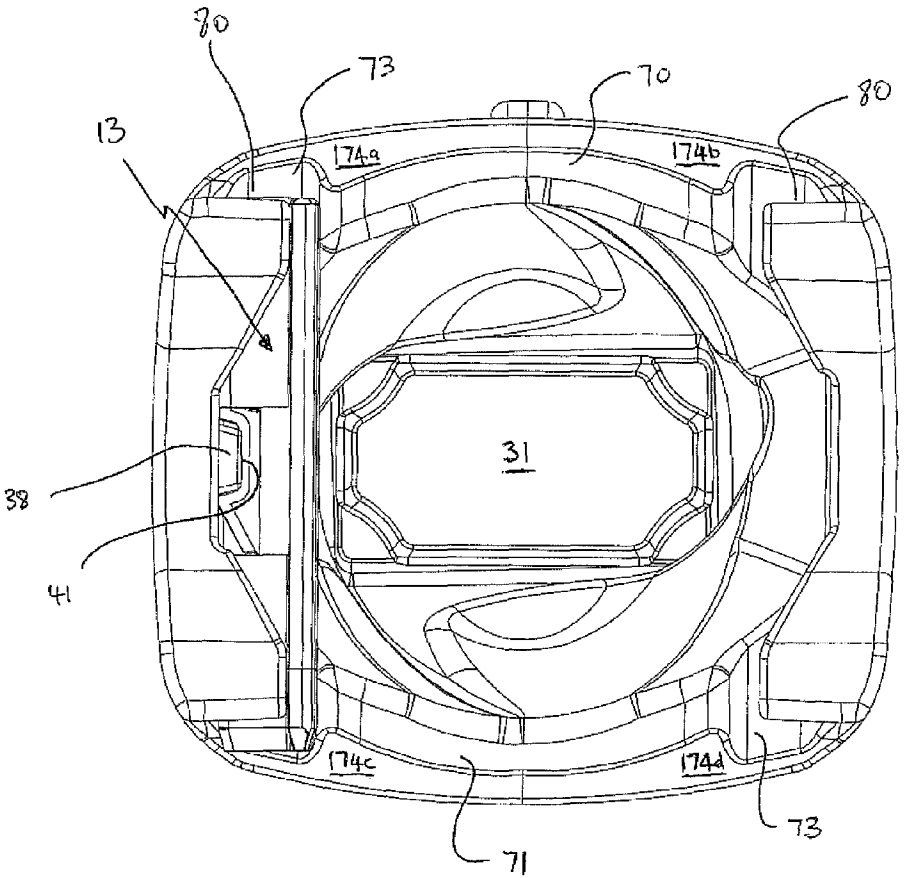
FIGS. 3 and 4 are rear and top views respectively of the assembled excavation tooth assembly of FIG. 1.
Figure 4:
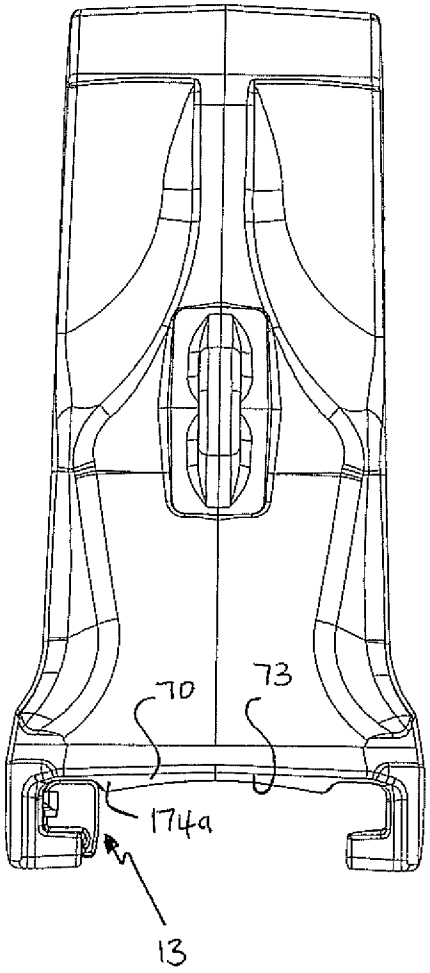
Figure 6:
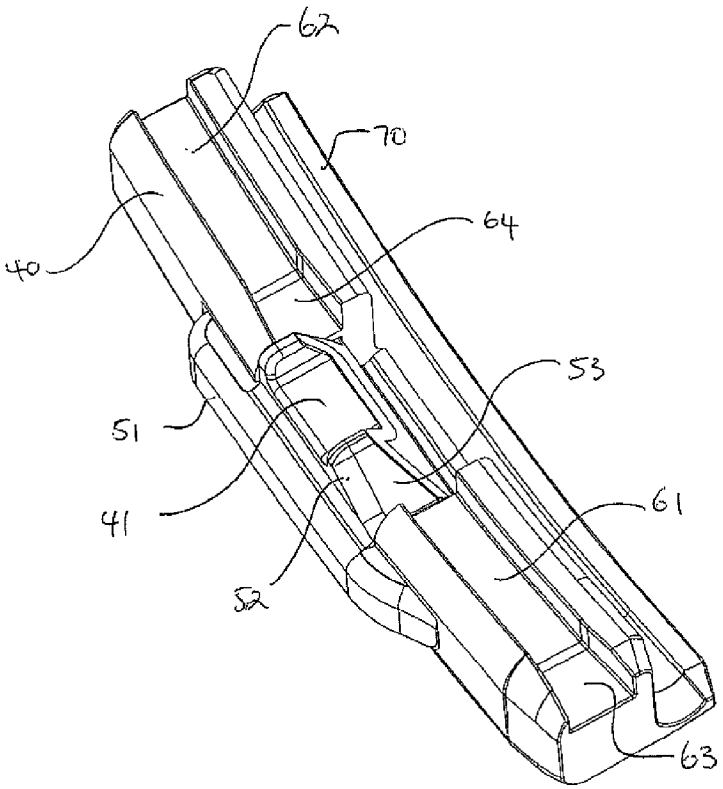
FIGS. 5, 6 and 7 are side, perspective and exploded views of a lock of the excavation tooth assembly of FIG. 1.
Figure 5:
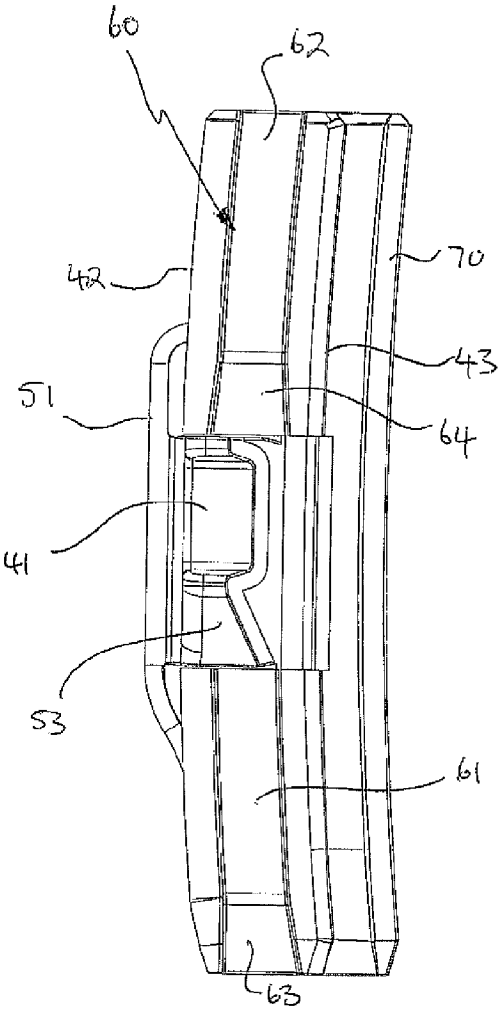
Figure 7:
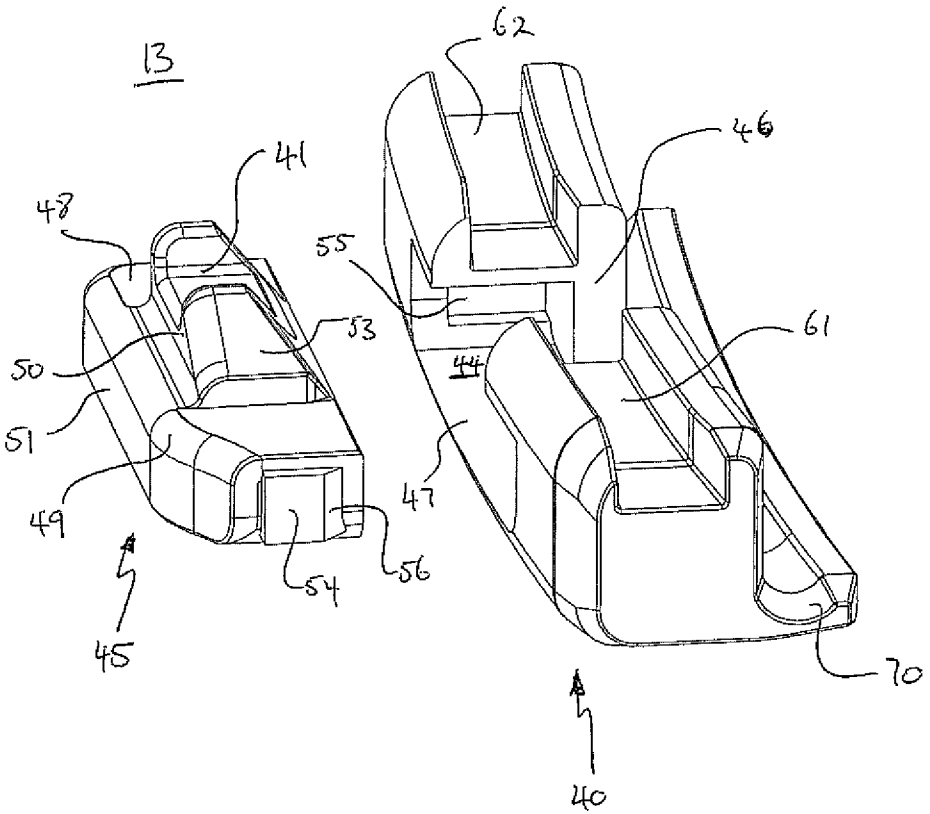
Figure 8:
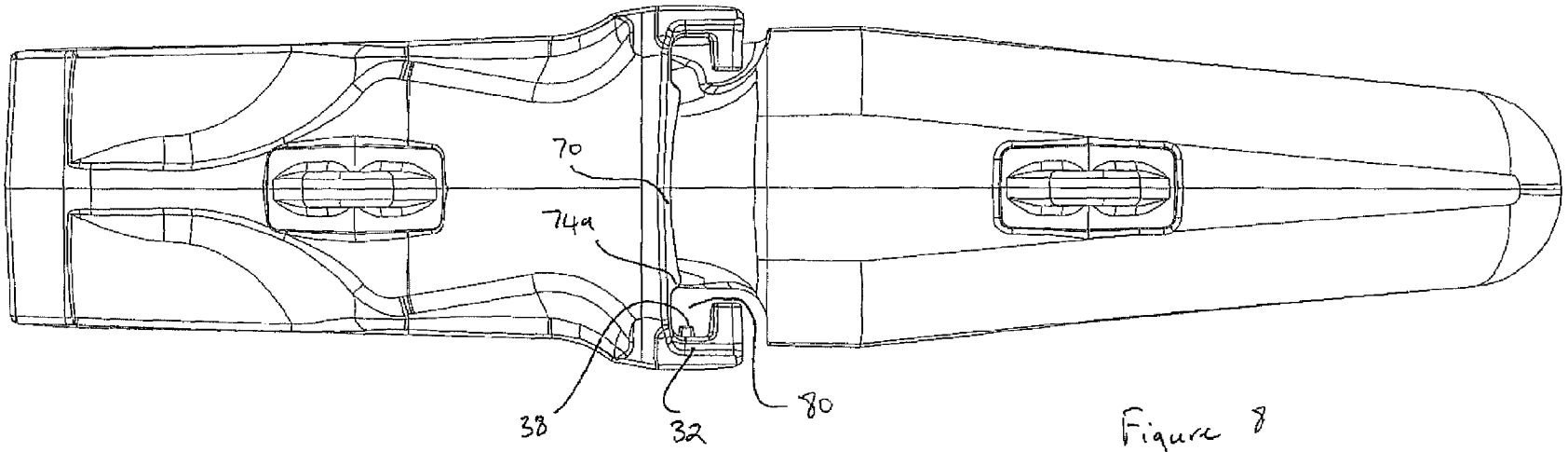
FIGS. 8 and 9 are a plan view and a cross-sectional plan view respectively of the point and adapter of the excavation tooth assembly of FIG. 1.
Figure 9:
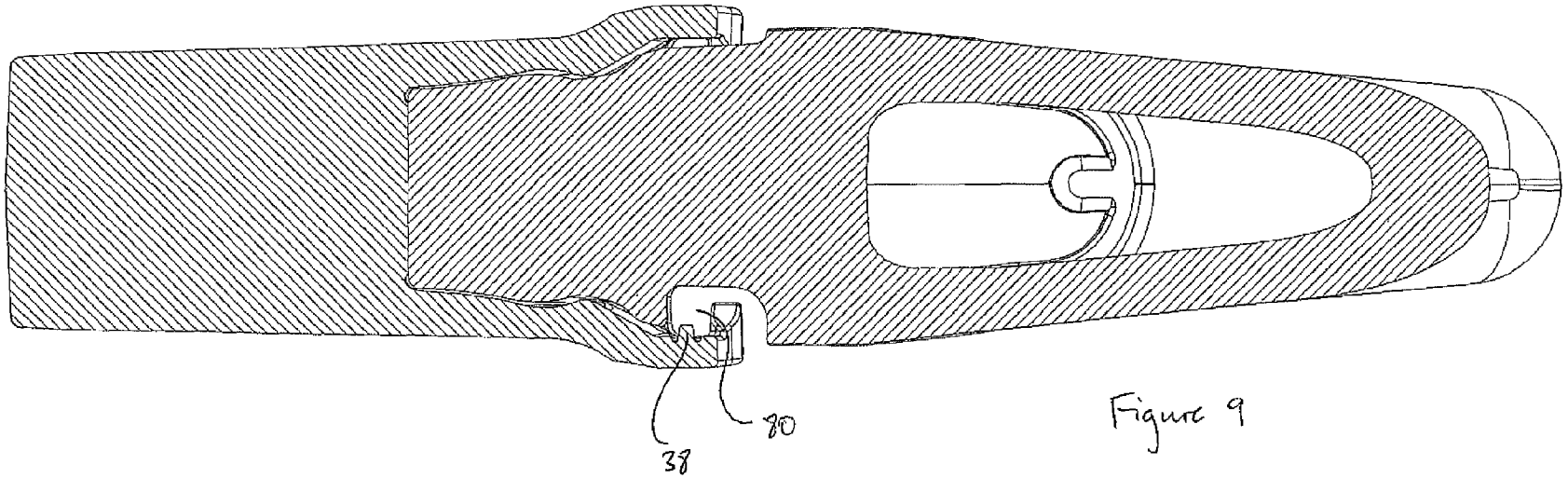
Figure 10:
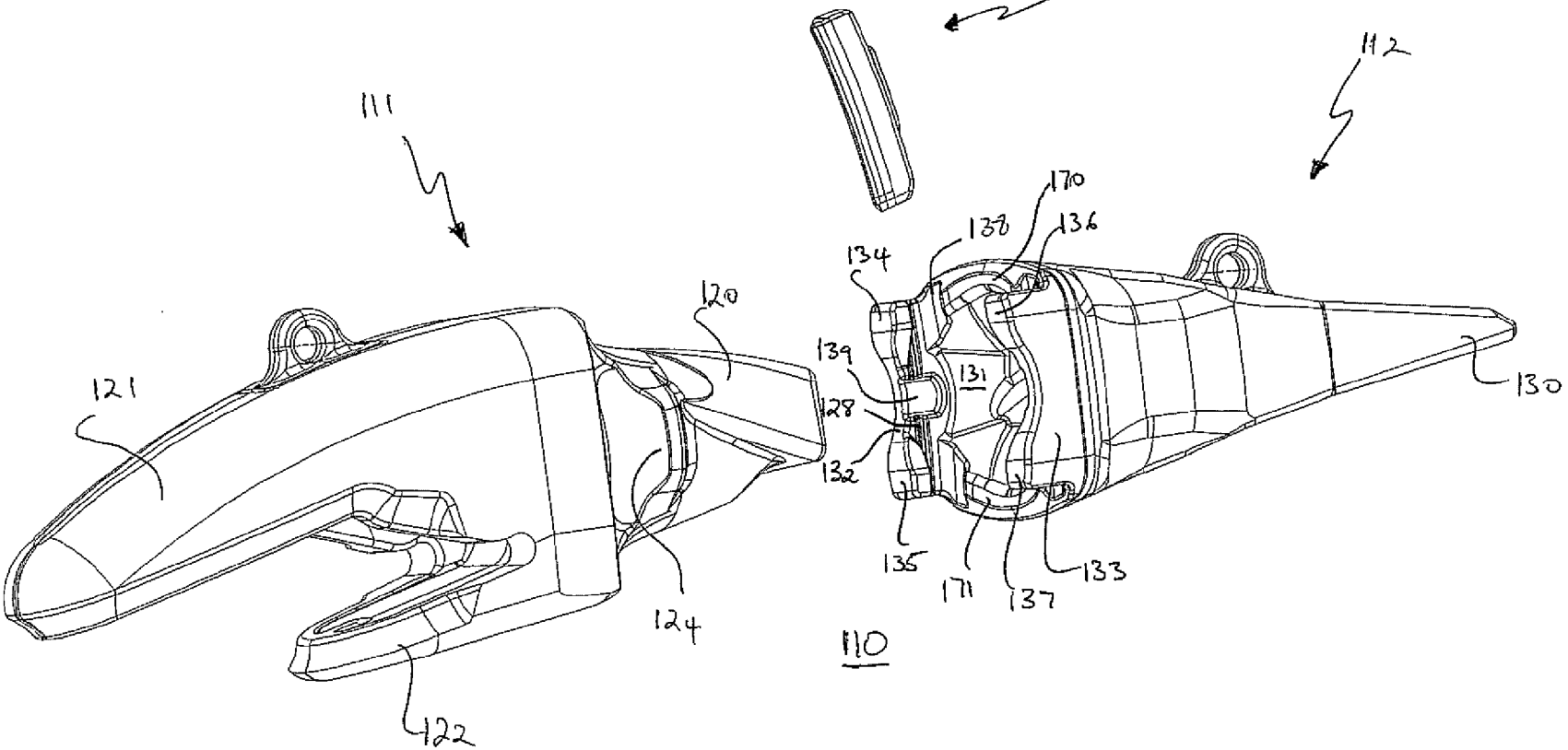
FIG. 10 is an exploded perspective view of an excavation tooth assembly according to another embodiment comprising an excavation tooth point, an excavation tooth adapter and a lock.

Referring in particular to FIGS. 3 and 4, the lock 13 comprises a body 40 in the form of a unitary metal (eg. steel) casing. The lock 13 also comprises a recess 41 for receiving the detent 38 of the point 12 to releaseably retain the lock within the locking space 80. The recess 41 shown in FIGS. 1-9 is in the form of an elongate slot. However, other suitable types of recesses may be employed such as circular or rectangular indentations or through holes. The lock 13 is inserted between the point 12 and the adapter 11 after they have been coupled together by hammering the lock 13 (or otherwise applying a sufficient force to the lock) into one of the locking spaces 80 until the detent on the relevant point ear 32, 33 is received in the lock recess 41. To remove the lock 13, a further force is applied in the same direction as was applied during insertion which is sufficient for the detent to clear the recess.

Although the embodiment shown and described in the Figures has the detent formed on a surface of the point, the detent may instead be formed on a surface of the adapter.

The body 40 of the lock 13 is elongate and slightly curved in its longitudinal direction such that it is slightly convex at its front 42 and slightly concave at its rear 43. Nominal descriptions of 'front' and 'rear' have been provided of the lock body 40 which conform with the orientation of the lock 13 with respect to the point 12 when it is inserted into the locking space between the point and the adapter 11 (see FIGS. 1 and 2).

The body 40 has a compartment 44 for receiving an insert 45 located in an intermediate portion of the body 40. For the lock 13 to be used, it is noted that the body 40 and insert 45 must be assembled with the insert received in the compartment 45. The compartment 44 has openings 46, 47 for portions of the insert 45 to protrude from when the insert 45 is received in the compartment 44. One of the openings 46 is located in the side of the body 40 and the other opening 47 is located at the front 42 of the body 40.

The insert 44 comprises a unitary elastomeric block 48 and two resilient bearing members 49, 50. The elastomeric block 48 allows the lock 13 to be deformed in order to insert (and remove) the lock 13 between the point 12 and the adapter 11. In particular, the elastomeric block allows the resilient bearing member 49, 50 to be pressed in as the lock is inserted (and removed). The elastomeric block 48 also biases the lock 13, specifically the resilient bearing members 49, 50, towards its at rest shape.

Although the lock shown in FIGS. 1-9 has a single insert comprising a unitary elastomeric block it is to be understood that the insert may comprise multiple elastomeric blocks or that the lock may comprise more than one insert each comprising one or more elastomeric blocks. For example, the first resilient bearing member may be mounted to a first elastomeric block and the second resilient member may be mounted to a second elastomeric block.

The resilient bearing members 49, 50 are typically formed of metal such as steel. The resilient bearing members may be formed as separate members and individually bonded to the elastomeric block 48 or they may be formed as a unitary element (which is bonded to the elastomeric block). The first resilient bearing member 49 is located on a front face of the elastomeric block 48 and protrudes from the front opening 47 of the compartment 44. The first resilient bearing member 49 provides an adapter bearing face 51 for bearing against the adapter 11 when the lock is in its operative position and locking the point to the adapter. More specifically, the adapter bearing face 51 is for bearing against one of the adapter ledges 24. The adapter bearing face 51 also aids in the locking of the point 12 to the adapter 11 by acting against vertical forces of rotation on the point 12.

The rear 43 of the lock body bears against one of the pairs of lugs (34 and 35 for example) when the lock is in its operative position and locking the point to the adapter. This bearing of the lock body rear 43 provides a opposing force to the adapter bearing face 51. Notably, because the adapter bearing face 51 is mounted to the elastomeric block 48, the lock self tightens as it or the adapter wears. This is because the elastomeric block pushes the adapter bearing face 51 outwards from the lock.

The second resilient bearing member 50 is located on a side face of the elastomeric block 48 and protrudes from the side opening 46 of the compartment 44. The second resilient bearing member 50 has the recess 41 of the lock 13 formed therein. Because of the position of the compartment 44 in the body 40, the recess 41 is located at an intermediate portion of the lock 13. The recess 41 is in the form of an elongate slot, which is elongate in the longitudinal direction of the lock body 40 (but may be elongate transversely to the longitudinal direction of the lock body in other embodiments). The dimensions of the recess 41 ensure that the detent 38 of the point resides firmly in the recess 41 once received therein (ie. the detent 38 is not free to move around in the recess 41) to avoid the lock slipping after it has been inserted into its locking position.

The lock 13 also comprises a shoulder element 52 which is formed on the second resilient bearing member 50 for aiding the lock in passing over the detent as the lock is inserted into the locking space before the detent is captured in the recess. The shoulder element 52 provides a sloping bearing face 53 or ramp which rises towards the detent entry side of the recess. When the lock is inserted between the point and the adapter, the sloping bearing face 53 engages and travels over the detent 38 with increasing force on the shoulder element 52 towards the lock 13. Compression of the underlying elastomeric block 48 occurs under this force allowing the shoulder element 52 to gradually clear the detent 38. Once the lock has been sufficiently inserted to align the recess 41 with the detent 38, the bias of the elastomeric block 48 pushes the recess 41 towards the detent 38 so that the detent is received therein.

The insert 45 also comprises tabs 54 at its top and bottom for keying into depressions 55 at the top and bottom of the compartment 44 to lock the insert 45 into the compartment (see FIG. 4). The insert 45 is received in the compartment 44 through the front opening 47. During this process, the tabs 54 deflect into the insert 45 as angled engaging surfaces 56 of the tabs 54 initially engage the top and bottom of the compartment respectively. This enables the insert 44 to clear the opening 47. However, the tabs 54 are biased towards their at rest position and thus once they align with the depressions 55 move outwardly to be received therein to lock the insert in the compartment. It is to be understood that the insert 45 may comprise mechanisms other than the tabs for securing the insert 45 in the compartment 44. For example, the tabs could be formed on the lock body and the depressions formed in the insert or a chemical bond may be formed between the insert and the body 40. In another arrangement, the insert may have a ledge which abuts a lip of the compartment once the insert has been positioned in the compartment. In this arrangement, the abutment of the ledge on the lip prevents the insert from inadvertently coming out of the compartment.

The lock 13 also comprises a groove 60 for enabling the lock to clear the detent 38 when inserting the lock into and removing the lock from the locking space between the adapter and the point. Accordingly, the width and depth of the groove along its length is approximately equal to or slightly greater than the width and height of the detent 38. The groove 60 is formed in a side of and extends the length of the lock body 40. The groove 60 is slightly curved with the curvature of the lock body 40. The groove 60 comprises first and second groove portions 61, 62 either side of the recess 41 (and either side of the side opening 46 of the compartment 44). The first groove portion 61 widens at its distal end 63 from the recess 41. The distal end of the first groove portion is at the leading edge of the lock 13 as it is inserted. The wider distal end 63 thus helps locate the detent 38 into the groove 60 as the lock is inserted. The second groove portion 62 widens at its proximal end 64 to the recess 41. The wider proximal end 64 similarly helps locate the detent 38 into the groove 60 when the lock is being removed and the recess is pushed over the detent 38.

The lock 13 also comprises a ridge 70 extending from the rear 43 of the lock body 40 for engaging the ears 34-37 on one of the point walls 32, 33. The ridge 70 acts as a key to prevent the lock 13 being inserted into the space between the point 12 and the adapter 11 in the wrong orientation in which it could possibly get jammed.

The excavation tooth assembly 10 also comprises upper and lower ridges, 70 and 71 respectively, which project from the rear surface 73 of the point 12. The rear surface 73 of the point 12 is provided at the second end of the point body. The ridges 70, 71 are formed above and below the socket 31 (which opens in the rear surface 73). The ridges 70, 71 extend between butare spaced from the rearwardly extending ears 32, 33. The ridges 70, 71 extend transversely across the rear surface 73 of the point and are concave in shape with thicker end portions 74*a-d* that project further from the rear surface of the point 12 than the central portion of each ridge. The outwardly facing lateral surfaces of the end portions 74*a-d* form opposing surfaces with their respective opposing ears 32, 33. The end portions 74*a,b* of the upper ridge 70 form upper opposing surface portions and the end portions 74*c,d* of the lower ridge form lower opposing surface portions. These opposing surfaces together with the rear surface 73 also form part of the locking spaces 80 into which the lock 13 can be inserted to lock the point 12 to the adapter 11. The opposing surfaces extend from a rear portion of the point (at the second end of the point body) towards the front of the point, which is at the first digging end of the point body.

The provision of the ridges 70, 71 constrains the top and bottom of the lock 13 against lateral movement with respect to the point 112 once inserted into its operative position in the locking. This ensures that the recess 41 of the lock=13 remains engaged with the detent 38 on the point when the parts of the assembly 10 become worn through use. In particular, the ridges advantageously enable the excavation tooth assembly to incorporate adaptors with very worn nose portions because the lock is held in the locking space without any involvement from a surface of the adaptor.

In a variation not shown in the Figures, the upper and lower ridges may be replaced with protrusions which extend from the rear surface 73 at a location near to but spaced from the rearwardly extending ears 32, 33. Such protrusions form opposing surfaces with respective ears and provide the function of the end portions 74*a-d* of the ridges to constrain the top and bottom of the lock against lateral movement with respect to the point.

In a further variation, at least one indentation is provided at the second end of the point body which defines the opposing surfaces. In this embodiment, each indentation extends from a rear portion of the point towards the front of the point.

Figure 11:
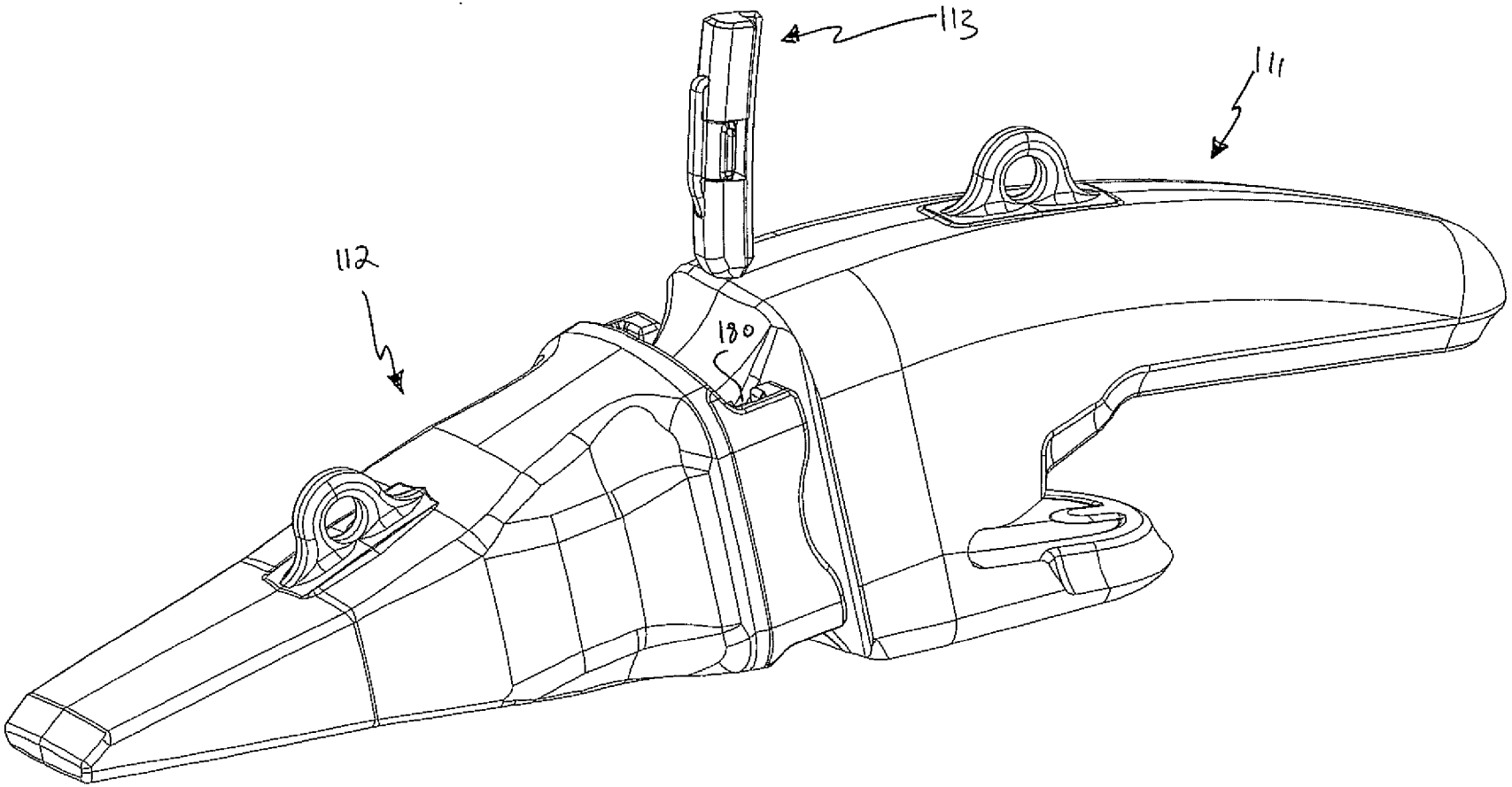
FIG. 11 is a perspective view of the excavation tooth assembly of FIG. 10 showing the lock being inserted into a locking space between the point and the adapter to lock the point to the adapter.
Figure 12:
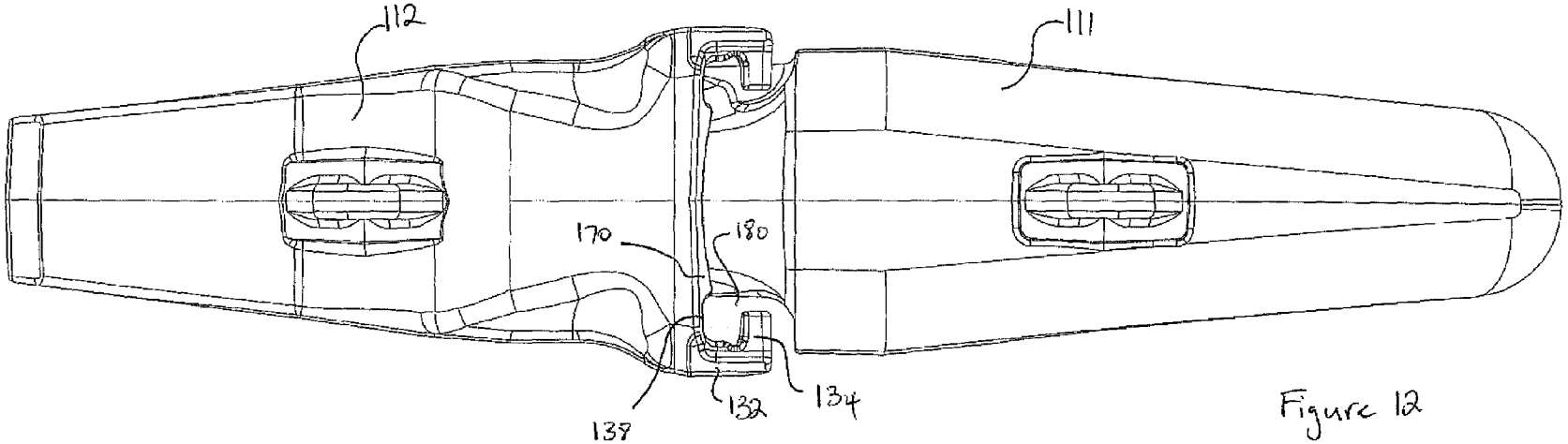
FIG. 12 is a plan view of the point and the adapter of the excavation tooth assembly of FIG. 10 in an assembled condition.
Figure 13:
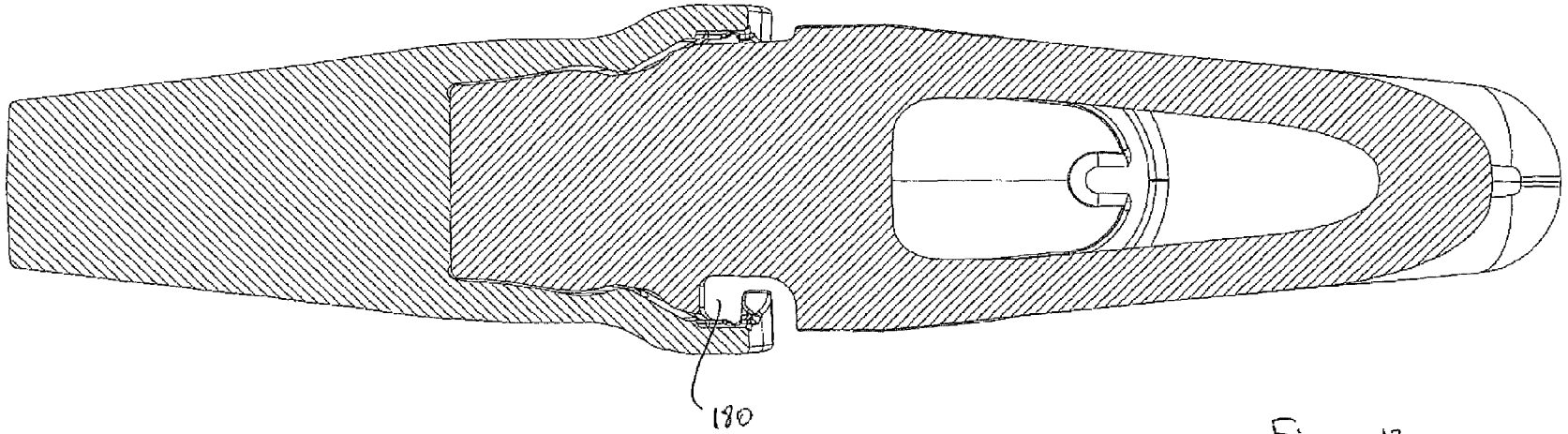
FIG. 13 is a cross-sectional plan view of FIG. 12.
Figure 14:
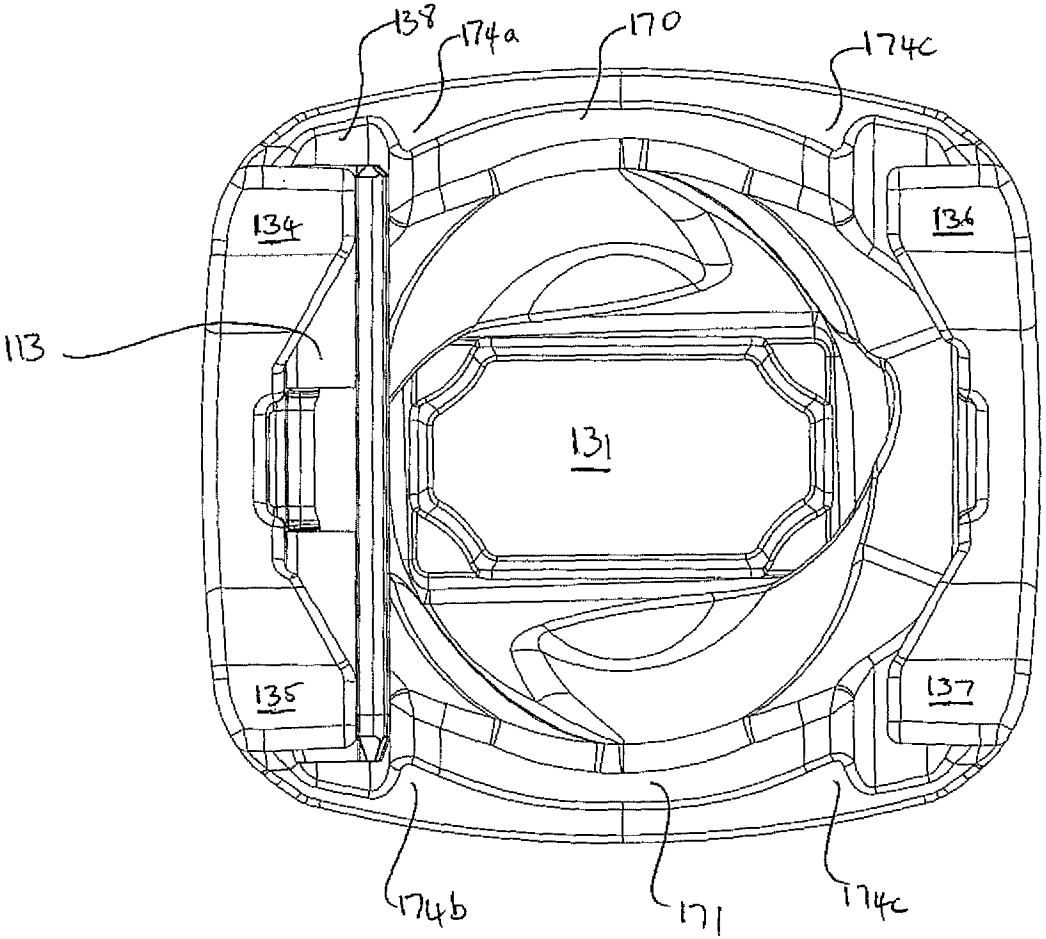
FIG. 14 is a rear end view of the point of FIG. 10 with the lock in an operative position where it would lock the point to the adapter.
Figure 15:
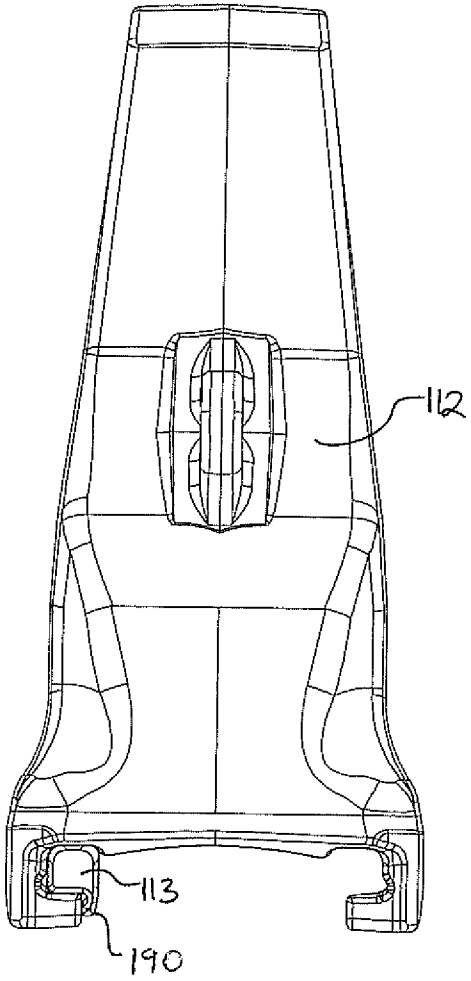
FIG. 15 is a plan view of FIG. 14.
Figure 16:
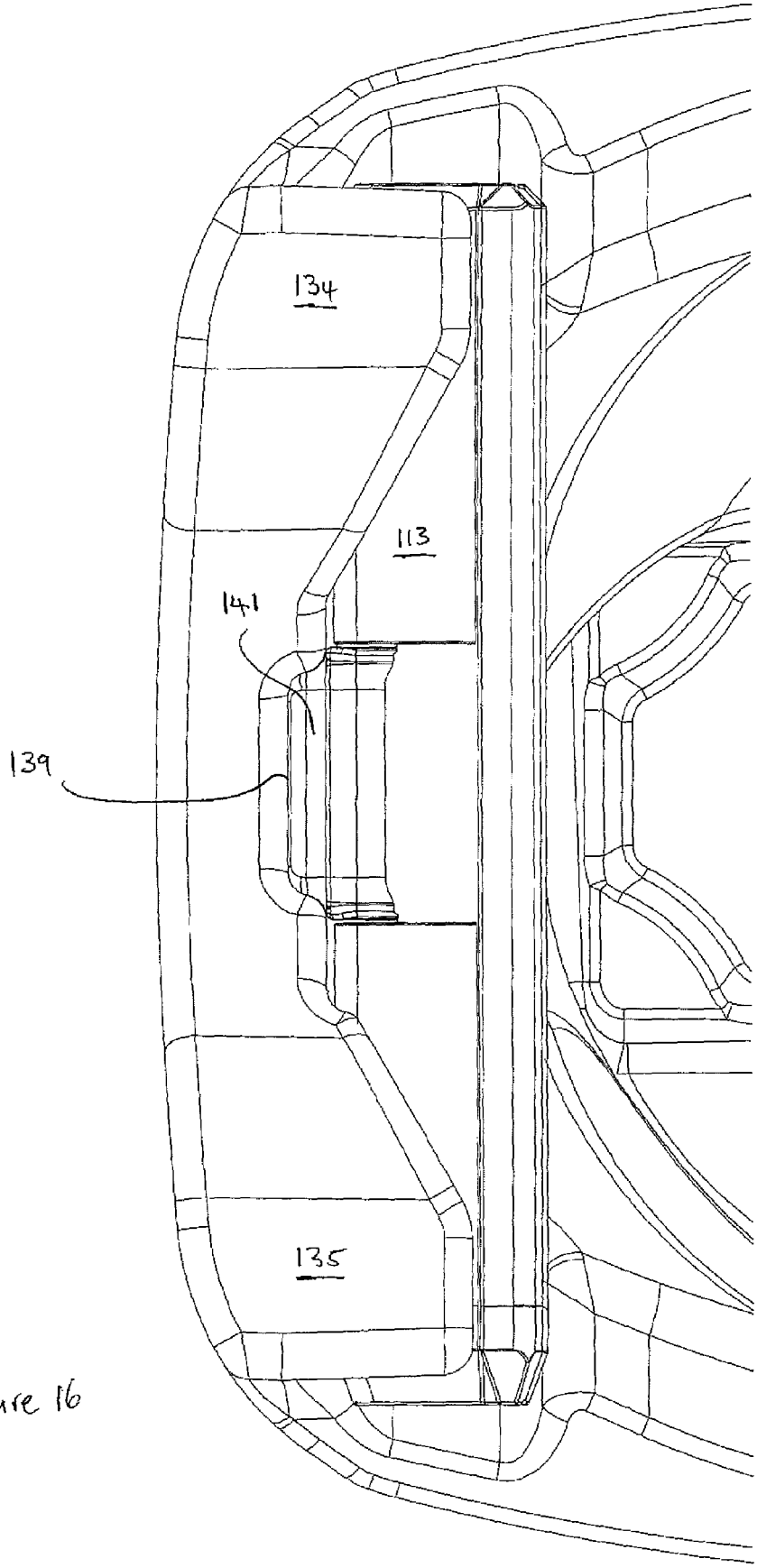
FIG. 16 is a close-up view of FIG. 14.
Figure 17:
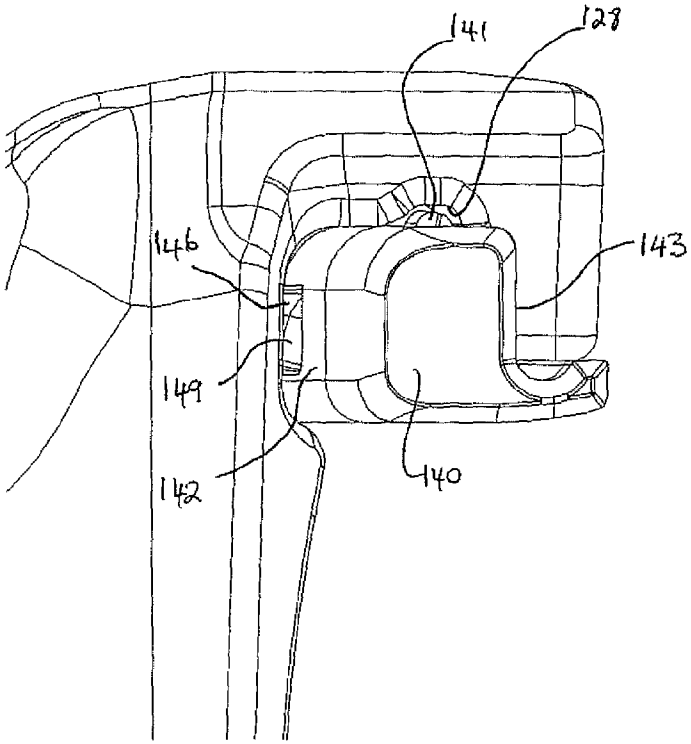
FIG. 17 is a close-up underneath view of the lock and point of FIG. 14.
Figure 18:
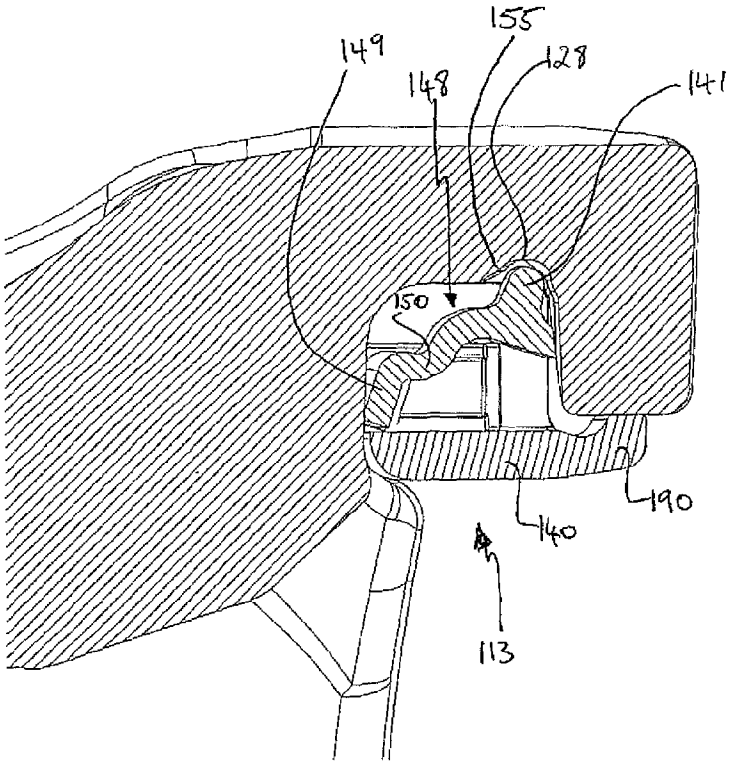
FIG. 18 is a cross-sectional view of FIG. 17.
Figure 19:
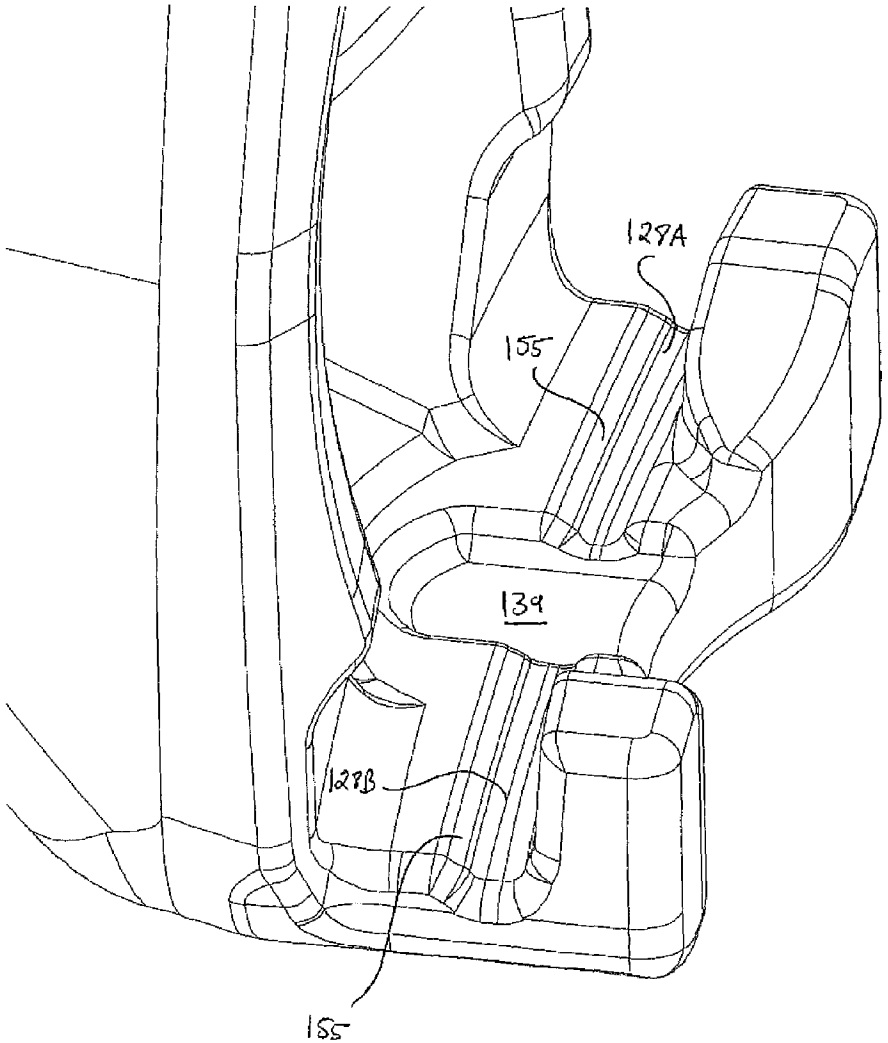
FIG. 19 is perspective view of a rear part of the point of FIG. 10, in particular showing an ear of the point which forms part of the locking space.
Figure 20:
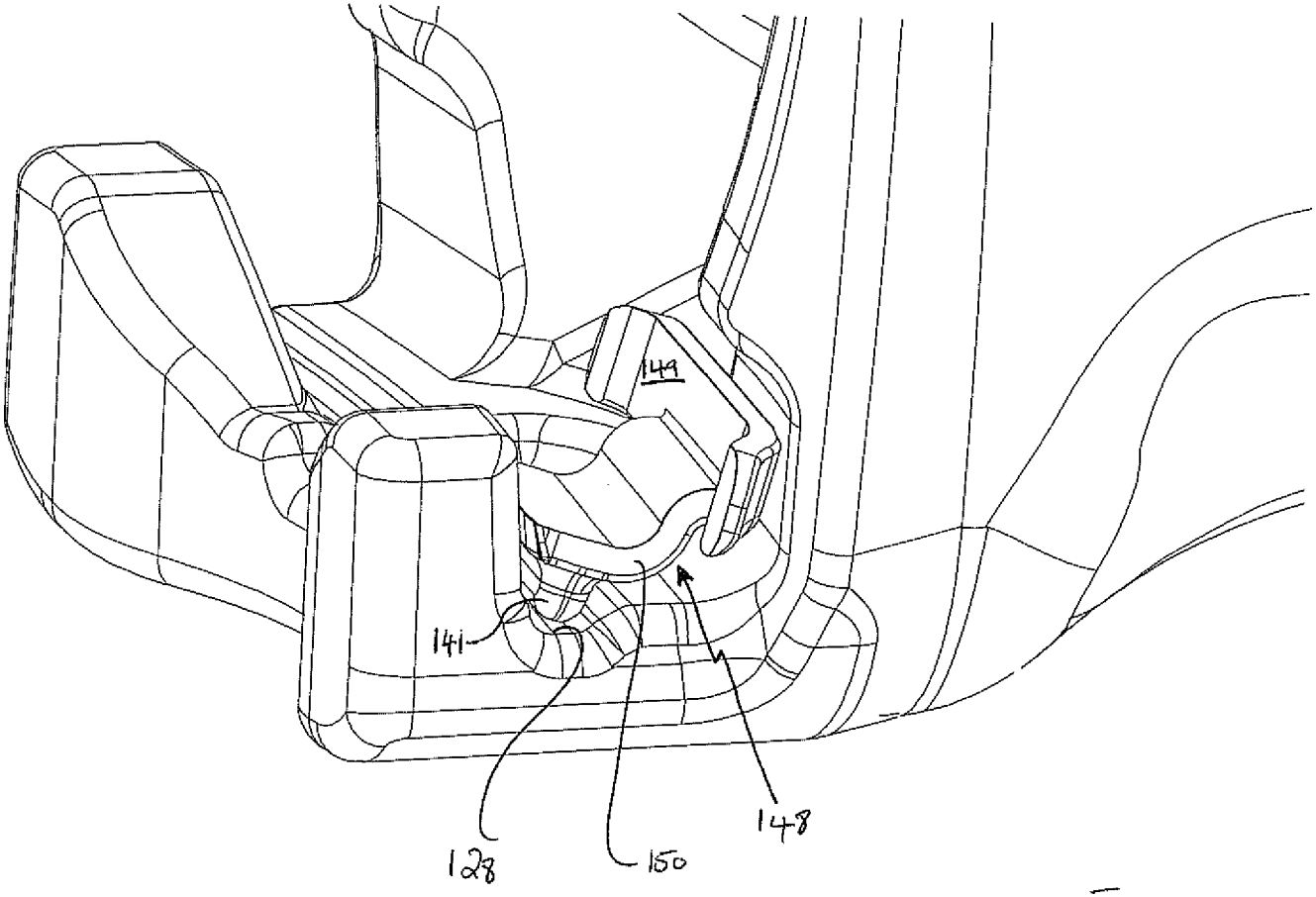
FIG. 20 is perspective view of the ear of the point of FIG. 10 showing the position of an engaging element of the lock (in isolation) with respect to the point as the lock is initially inserted into the locking space.
Figure 22:
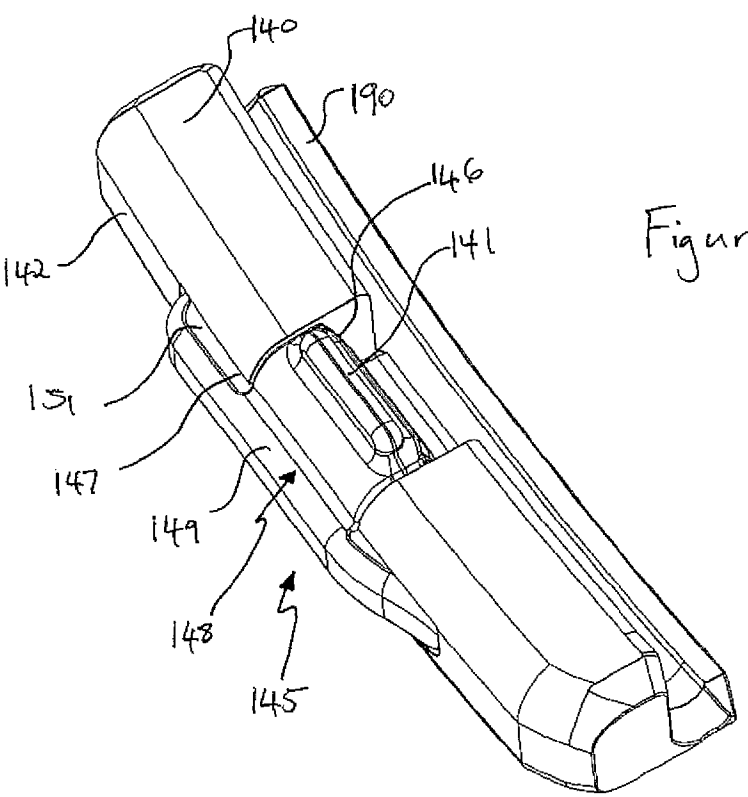
FIGS. 21 and 22 are side and perspective views of the lock of FIG. 10.
Figure 21:
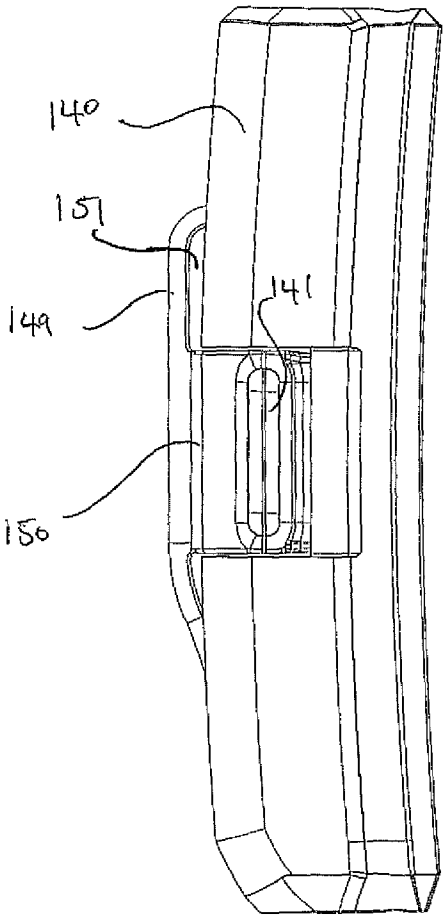
Figure 23:
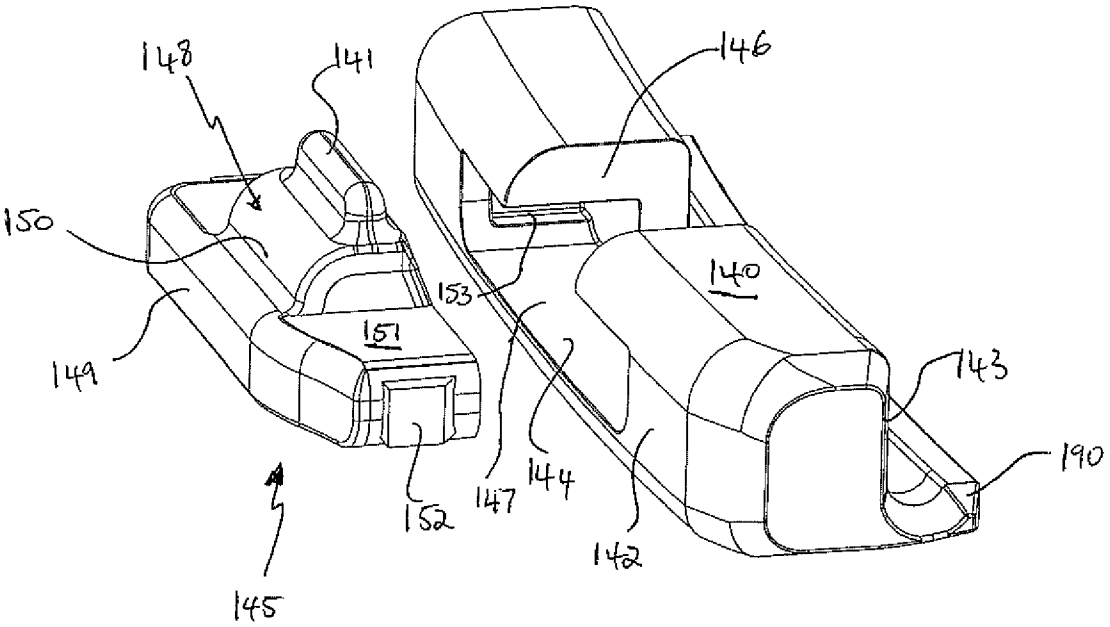
FIG. 23 is an exploded perspective view of the lock of FIG. 10.
Figure 24:
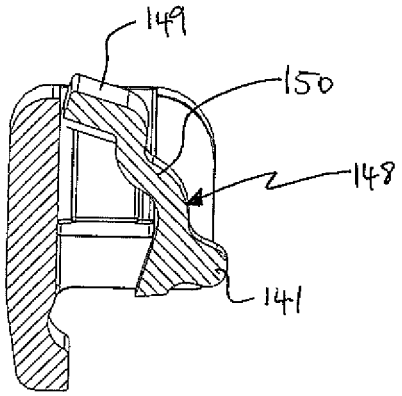
FIG. 24 is a top perspective view of the lock of FIG. 10 with an engaging element of the lock in a retracted condition.
Figure 25:
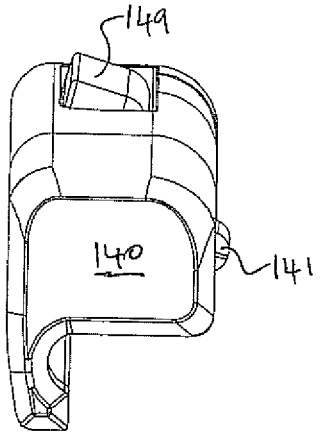
FIG. 25 is a cross-sectional view of FIG. 24.

Referring now to FIGS. 10-25, an excavation tooth assembly 110 according to another embodiment is shown. The assembly 110 has similar features to the excavation tooth assembly 10 shown in FIGS. 1-9. The assembly 110 comprises an excavation tooth adapter 111 for mounting the excavation tooth to the digging edge of digging equipment, an excavation tooth point 112 which couples to the adapter 111 in an assembled condition (FIG. 11) and a lock 113 for locking the point 112 to the adapter 111 when in their assembled condition to form the excavation tooth.

The adapter 111 comprises a forward projecting nose 120 and rearward arms 121, 122. The rearward arms 121, 122 are positioned at either side of the digging edge of digging equipment in order to mount the adapter 111 thereto. Again, as illustrated he forward projecting nose 120 has a "twisted" shape to reduce the torsion stresses on the adapter in use. Ledges 124 project from either side of the nose 120, the purpose of which will be described below.

The point 112 comprises a digging edge 130 at a first end and a socket 131 at an opposite second end for receiving the nose 120 of the adapter 111 the point extends along a longitudinal axis between its first and second ends. The socket 131 opens in a rear surface 138 of the point and has an internal "twisted" shape, which conforms with the shape of the adapter nose 120. The point 112 is thus assembled with the adapter 111 by positioning the socket 131 at the end of the nose 120 and then twisting and pushing the point 112 until the nose 120 is received in the socket.

Ears 132, 133 on either side of the point 112 extend rearwardly of the rear surface 138 away from the socket 131. Each ear 132, 133 has upper and lower lugs 134-137 extending inwardly towards the opposite ear at right angles to their respective ears. The lugs 134-137 are located at the distal end of their respective ears 132, 133. When the point 112 is assembled with the adapter 111 with the adapter nose 120 fully received in the point socket 131, one of the ears, its respective lugs and a portion of the rear surface 138 of the point 112 together with one of the ledges 124 of the adapter 111 create a locking space 180 on one side of the excavation tooth into which the lock 113 can be inserted to lock the point and the adapter in their assembled condition. The other of its ears, its lugs, another portion of the point's rear surface 138 and the other ledge is also capable of creating a locking space on the other side of the tooth. It is noted, however, that as the tooth in many applications requires only one lock (and hence one locking space) that in some embodiments the point may differ from the embodiment shown in FIGS. 10-25 in having only one ear.

The point 112 also comprises an engaging portion in the form of a recess 139 for interengaging with an engaging portion of the lock 113 to lock the point and the adapter in their assembled condition. The recess 139 is located on one of the ears 132 at an intermediate portion of the ear located vertically between the lugs 134, 135. The recess 139 extends in the longitudinal direction of the point 112 (ie. parallel to the longitudinal axis of the point), from a rear edge of the ear 132 towards the digging edge of the point and slightly into the opening of the socket 131. A further recess which is identical to the recess 139 shown, is located at an identical position on the other ear of 133. This enables the point 112 to be assembled with and locked to the adapter in an upside down orientation to that shown in FIGS. 10-25. This is particularly useful in extending the life of the point 112 if the digging edge 130, in use, is wearing more on the top or bottom.

The point 112 also comprises a groove 128 extending transversely with respect to the longitudinal axis of the point 112 and is slightly curved. The groove 128 is formed in the ear 132 and comprises upper and lower groove portions 128A, 128B above and below the recess 139 respectively. Upper groove portion 128A extends from the top of the ear 132 to the recess 139 and similarly the lower groove portion 128B extends from the bottom of the ear to the recess. The purpose of this groove 128 will be described in further detail with respect to the lock below. It is noted that as with the recess, a further identical groove is provided on the other ear 133 so that the point 112 can be used in an upside down orientation to that shown in FIGS. 10-25. In another variation (not shown), the recess 139 and the groove 128 are formed on a surface of the adapter which forms part of the locking space.

The point also comprises upper and lower ridges 170 and 171 respectively, which are project from the rear surface 138 of the point 112. The ridges 170, 171 are similar to the ridges 70-71 shown and described in relation to FIGS. 1-9. The ridges 170, 171 are formed above and below the socket 131 and are spaced from the rearwardly extending ears 132, 133. The ridges 170, 171 extend laterally across the rear surface 138 of the point and are concave in shape with thicker end portions 174*a-d* that project further from the rear surface of the point 112 than the central portion of each ridge. The side surfaces of the end portions 174*a-d* form opposing surfaces with their respective opposing ears 132, 133. These opposing surfaces also form a part of the locking spaces 180. The opposing surfaces extend from the second end of the point body towards the first digging end of the point body, parallel to the longitudinal axis of the point.

Referring in particular to FIGS. 21-25, the lock 113 comprises a body 140 in the form of a unitary metal (eg. steel) casing. The lock 113 also comprises an engaging portion in the form of a projection 141 mounted to the lock body and which is configured to be received in the recess 139 of the point 112 to releaseably retain the lock within the locking space 180. The recess 139 and the projection 141 form a lock assembly which when coupled act to releasably retain the lock within the locking space 180. The lock 113 is inserted between the point 112 and the adapter 111 after they have been coupled together by hammering the lock 113 (or otherwise applying a sufficient force to the lock) into one of the locking spaces 180 until the projection 141 of the lock is received in the recess 139 of the point. To remove the lock 113, a further force is applied in the same or opposite direction as was applied during insertion which is at least initially sufficient for the projection to clear the recess and then to drive the lock 113 out of the locking space 180.

The body 140 of the lock 113 is elongate along a longitudinal axis and slightly curved in its longitudinal direction such that it is slightly convex at its front surface 142 and slightly concave at its rear surface 143. Nominal descriptions of 'front' and 'rear' have been provided of the lock body 140 which conform with the orientation of the lock 113 with respect to the point 112 when it is inserted into the locking space 180 between the point and the adapter 111 (see FIGS. 10 and 11).

The body 140 has a cavity 144 for receiving an insert 145 located in an intermediate portion of the body 140. For the lock 113 to be used, it is noted that the body 140 and insert 145 must be assembled with the insert received in the cavity 145. The cavity 144 has openings 146, 147 for portions of the insert 145 to protrude from when the insert 145 is received in the cavity 144. One of the openings 146 is through a side surface of the body 140 and the other opening 147 is through the front surface 142 of the body 140.

The insert 145 comprises an engaging element 148 for engaging a surface of the adapter to lock the point and the adapter in their assembled configuration as well as to hold the lock in the locking space 180. The engaging element 148 is a unitary member formed from a metal such as steel. The engaging element 148 incorporates the projection 141 which is configured to be received in the recess 139 of the point so as to hold the lock in the locking space 180. The engaging element 148 also incorporates a second engaging portion in the form of a second projection 149 for engaging a surface of the adapter, specifically one of the ledges 124. The second projection 149 is angularly spaced from the first mentioned projection 141 about the longitudinal axis of the lock body by approximately 90° (and remains so at all times during use). The second projection 149 projects through the opening 147 in the front of the 142 of the lock body 140. The first projection 141 projects through the opening 146 located in the side of the body 140. The engaging element 148 also comprises a web 150 connecting the second projection 149 and the first projection 141. The web 150 has a 90° bend in it in order to extend between the first projection and the second projection. Although there may be a small amount of flex in the web 150, it generally holds the first projection 141 and the second projection 149 in their orientation with respect to each other at all times during use of the lock.

Both the first projection 141 and the second projection 149 have a first at-rest and extend position (see FIGS. 21 and 22) in which they extend beyond respective outer surfaces of the lock body 140 and a second, retracted position (see FIGS. 24 and 25) in which they are retracted relative to the lock body, but still extend beyond respective outer surfaces of the lock body.

The insert 145 also comprises a resilient biasing element in the form of an elastomeric block 151 for biasing the first projection 141 and the second projection 149 towards their first at-rest positions. The elastomeric block 151 is held within the cavity 144, having upper and lower tabs 152 which are received in recesses 153 within the cavity to keep the elastomeric block 151 in the cavity 144. The engaging element 138 is bonded to the elastomeric block 151.

When the lock 113 is inserted into the locking space 180, the second projection 149 and the first projection 141 are caused to retract from their respective first positions towards their respective second positions. Because the first projection and the second projection are integrally formed as part of the engaging element 148, movement of one results in movement of the other (ie. their movement is interdependent). As the lock is inserted into the locking space, the second projection 149 initially engages a surface of the locking space causing it to be retracted into the lock body 140. This causes a corresponding retraction of the first projection 141.

As the lock is continued to be inserted into the locking space, the first projection 141 is captured in the groove 128. The groove 128 provides a guide for the first projection 141 as the lock is being inserted as well as preventing excessive retraction of the first projection 141 (and thus over-compression of the elastomeric block 151). The groove 128 causes further retraction of the first projection 141 into its second position (and thus also of the second projection 149 by its interdependent with the projection). In addition, a shoulder 155 of the groove also causes the first projection 141 to move laterally with respect to the lock body 140, which causes the second projection 149 to be further pulled in towards the lock body 140 (see FIGS. 18 and 20). This translation and retraction of the first projection 141 results in a rotation like movement of the engaging element 148 and of the first and second projections. Once the first projection 141 is aligned with the recess 139 in the point 112, the first projection 141 releases into the recess 139 under the resilient bias of the elastomeric block 151. This holds the lock 113 in its operative position within the locking space. The second projection 149 makes a corresponding movement towards its first position to engage one of the ledges 124 of the adapter 111. This locks the point and the adapter in their assembled condition. The resilient bias of the elastomeric block 151 means that as the parts of tooth wear in use, the second projection 149 moves towards its first position to "take-up" any gap due to wear. Because the recess 139 in the point extends parallel to the longitudinal axis of the point, the first projection 141 is free to adjust its position, in particular as the projection 149 moves due to "take-up" caused by wear.

The provision of the ridges 170, 171 on the point 112, in particular their end portions 174*a-d*, also constrains the top and bottom of the lock 113 against lateral movement with respect to the point 112 once inserted into the locking configuration. This ensures that the projection 141 remains engaged with the recess 139 on the point when the parts of the assembly 110 become worn through use.

The lock 113 also comprises a ridge 190 extending from the rear 143 of the lock body 140 for engaging the ears 134-137 on one of the point walls 132, 133. The ridge 190 acts as a key to prevent the lock 113 being inserted into the space between the point 112 and the adapter 111 in the wrong orientation in which it could possibly get jammed.

It is to be understood that, unless indicated otherwise by express language or necessary implication, the tooth members or locking members according to any embodiment of one aspect of the present invention may further encompasses any one or combination of features described above in relation to embodiments of other aspects of the present invention.

It is also to be understood that whilst the above description has been made in respect of a two part excavation tooth assembly (adaptor and point), the embodiments of the present invention described above may be incorporated into a three part excavation tooth assembly comprising an adaptor, a point and an intermediate member disposed between and coupling to each of the adaptor and the point. The intermediate member may have some of the features described above for the point and some of the features described above for the adaptor.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. An excavation tooth assembly comprising:

a first tooth member comprising a body having a first end and an opposite second end that incorporates a socket configured to receive a nose portion of a second tooth member, the first tooth member also comprising laterally facing opposing surfaces, the opposing surfaces and at least one surface of the second tooth member defining at least in part a locking space and wherein the laterally facing opposing surfaces are provided on respective projections projecting from the second end of the first tooth member's body; and a lock which is configured to be inserted into the locking space in an operative position to lock the first tooth member to the second tooth member.

2. An excavation tooth assembly according to claim 1, wherein the opposing surfaces comprise upper and lower opposing surface portions, wherein a top and a bottom of the lock is held between the upper and lower opposing surface portions respectively when the lock is in its operative position.

3. An excavation tooth assembly according to claim 2, wherein each upper opposing surface portion is spaced from its respective lower opposing surface portion.

4. An excavation tooth assembly according to claim 2, wherein the upper and lower opposing surface portions are located above and below the socket respectively.

5. An excavation tooth assembly according to claim 1, wherein one of the projections comprises an ear extending from the second end of the first tooth member's body, the ear providing one of the opposing surfaces which defines the locking space.

6. An excavation tooth assembly according to claim 1, wherein the projections that project from the first tooth member's body comprise upper and lower projections and wherein the laterally facing surfaces of each of the upper and lower projections respectively provide one of an upper and lower opposing surface.

7. An excavation tooth assembly according to claim 1, wherein the first tooth member comprises at least one transverse ridge, the ridge having opposite end portions wherein one end portion of the ridge provides one of the opposing surfaces of the locking space.

8. An excavation tooth assembly according to claim 7, wherein the opposing surfaces comprise upper and lower opposing surface portions, a top and a bottom of the lock held between the upper and lower opposing surface portions respectively when the lock is in its operative position and wherein the first tooth member comprises an ear extending from the second end of the first tooth member's body, the ear providing one of the opposing surfaces which defines the locking space and wherein the end portion of the ridge provides one of the upper and lower opposing surface portions which opposes the opposing surface provided by the ear.

9. An excavation tooth assembly according to claim 7, wherein one of the opposing surfaces is a side surface of the ridge.

10. An excavation tooth assembly according to claim 7, wherein the first tooth member comprises upper and lower ridges.

11. An excavation tooth assembly according to claim 7, wherein each ridge projects from a rear surface at the second end of the body of the first tooth member, the socket of the first tooth member opening in the rear surface.

12. An excavation tooth assembly according to claim 11, wherein the first tooth member comprises upper and lower ridges and wherein the upper and lower ridges project from the rear surface above and below the opening of the socket.

13. An excavation tooth assembly according to claim 7, wherein each ridge is concave.

14. An excavation tooth assembly according to claim 11, wherein the end portions of each ridge projects further from the rear surface of the first tooth member body than a central portion of that ridge.

15. An excavation tooth assembly according to claim 7, wherein the first tooth member comprises two ears extending from the second end of the first tooth member's body, each ear located on respective sides of the first tooth member and each ridge extends between the two ears, with each ridge's opposite end portions spaced from respective ears.

16. An excavation tooth assembly according to claim 1, wherein the projections are formed by an indentation in the first tooth member body at its second end.

17. An excavation tooth assembly according to claim 1, wherein the opposing surfaces extend from a rear portion of the first tooth member towards a front portion of the first tooth member.

18. An excavation tooth assembly according to claim 1, wherein the excavation tooth assembly comprises a first engaging element formed on one of the surfaces defining the locking space and a second engaging element formed on the lock, the first and second engaging elements arranged to interengage to releaseably retain the lock within the locking space.

19. An excavation tooth assembly according to claim 1, wherein the excavation tooth assembly further comprises the second tooth member having the nose portion receivable in the socket of the first tooth member.

20. An excavation tooth assembly according to claim 1, wherein the opposing surfaces each comprise upper and lower surface portions, a top and a bottom of the lock held between the upper and lower opposing surface portions respectively when the lock is in its operative position, and wherein one of the projections comprises an ear extending from the second end of the first tooth member's body and others of the projections comprises upper and lower projections, the upper and lower projections providing respective upper and lower surface portions of one of the opposing surfaces and the ear providing the other opposing surface.

21. An excavation tooth assembly according to claim 1, wherein each projection projects from a rear surface at the second end of the body of the first tooth member, the socket of the first tooth member opening in the rear surface.

22. An excavation tooth assembly according to claim 6, wherein the upper and lower projections project from a rear surface at the second end of the body of the first tooth member above and below an opening of the socket in the rear surface.

23. An excavation tooth member comprising:

a body having a first end and an opposite second end that incorporates a socket configured to receive a nose portion of a further tooth member; and laterally facing opposing surfaces, the laterally facing opposing surfaces provided on respective projections projecting from the second end of the tooth member's body, the opposing surfaces defining at least in part a locking space when the tooth member is assembled with the further tooth member, the locking space arranged to receive a lock for locking the tooth member to the further tooth member.

24. An excavation tooth member comprising:

a body having a first end and an opposite second end that incorporates a socket opening in a rear surface of the body and configured to receive a nose portion of a further tooth member;

at least one ear extending from the rear surface; and at least one projection projecting from the rear surface and spaced from the ear such that the projection and the ear have opposing surfaces, the opposing surfaces of the projection and the ear and the rear surface at least partly defining a locking space that is arranged to receive a lock to lock the tooth member to the further tooth member.

* * * * *